United States Patent [19]

Sweeny

[11] Patent Number: 4,603,041

[45] Date of Patent: Jul. 29, 1986

[54] CYCLIZATION OF ACRYLIC FIBER

[75] Inventor: Wilfred Sweeny, Wilmington, Del.

[73] Assignee: E. I. Du Pont de Nemours and Company, Wilmington, Del.

[21] Appl. No.: 632,250

[22] Filed: Jul. 19, 1984

[51] Int. Cl.[4] ..... D01F 9/22

[52] U.S. Cl. ..... 423/447.4; 423/447.6; 264/29.2

[58] Field of Search ..... 423/447.4, 447.6; 264/29.2

[56] References Cited

U.S. PATENT DOCUMENTS 3,661,616 5/1972 Miyamichi ..... 423/447.4
3,767,773 10/1973 Turner et al. ..... 423/447.4
4,024,227 5/1977 Kishimoto et al. .
4,336,022 6/1982 Lynch et al. .
4,349,523 9/1982 Hiramatsu et al. .

FOREIGN PATENT DOCUMENTS 55-71613 5/1980 Japan .

OTHER PUBLICATIONS

Research Disclosure Journal, May, 1977, p. 15.

*Primary Examiner*—Jack Cooper

[57] ABSTRACT

Improved process for producing a carbon fiber having high tensile strength and high modulus involves oxidation of acrylonitrile fiber which has been treated with selected ammonium salts, from the group of ammonium sulfamate, ammonium bromide and ammonium iodide.

4 Claims, 6 Drawing Figures

FIG. 5
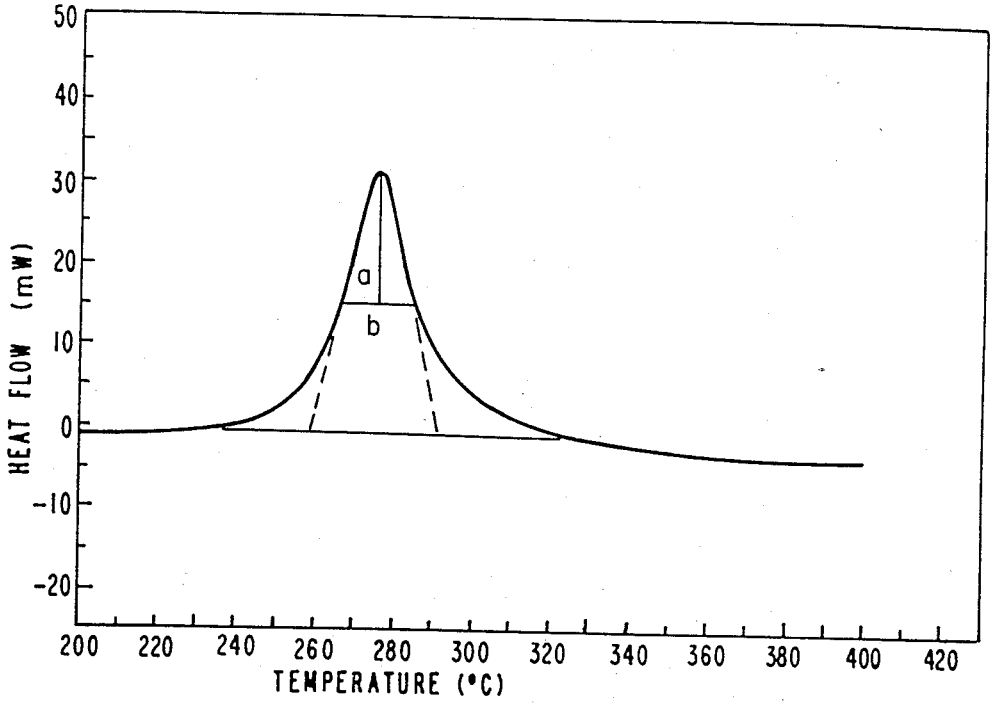
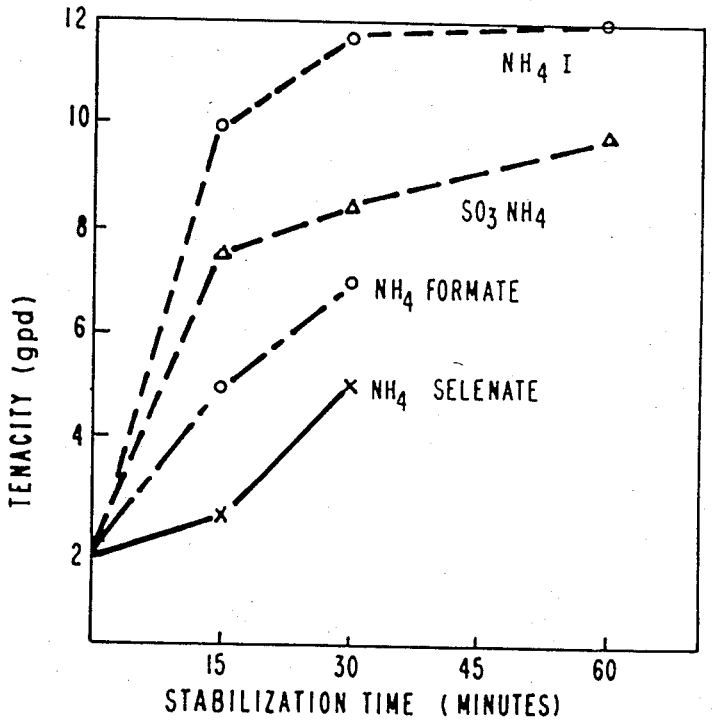
FIG. 6

CYCLIZATION OF ACRYLIC FIBER

BACKGROUND OF THE INVENTION

The major commercial route to high strength, high modulus carbon fiber is based on polyacrylonitrile precursors. Such fibers, which are useful as reinforcing elements, are generally prepared by heating the polyacrylonitrile fiber in an oxidizing atmosphere at 200° to 400° C. so as to form a cyclized structure in the fiber and then carbonizing the oxidatively cyclized structure at a higher temperature, generally above 800° C. Increase in density is considered a good qualitative measure of cyclization (see Density Changes in Acrylic Fibers by Thermal Stabilization, Takaku et al, Sen i Gakkaishi, 38 (9), 82–8 (1982) and Carbon Work at the Royal Aircraft Establishment, W. Watt, Carbon 1972, 10, 121–143). The oxidative cyclization step is highly exothermic and releases ≧400 Joules/g of heat rapidly. If not controlled, this leads to deorientation and/or melting of the polyacrylonitrile fiber and results in low tensile properties in both stabilized and carbonized fiber. Improvements in control of this heat flux have been described in U.S. Pat. No. 4,336,022, wherein it is accomplished by use of ammonium sulfonate comonomers. Further improvements in control of heat evolution on oxidation are desirable and result from the present invention.

BRIEF DESCRIPTION OF THE DRAWINGS

FIG. 5 shows measurement of Heat Flux Index on a DSC scan.

FIG. 6 shows tensile properties of carbonized fibers whose precursors had been treated with a number of different compounds prior to cyclization as described in Example 7.

SUMMARY OF THE INVENTION

Figure 1:
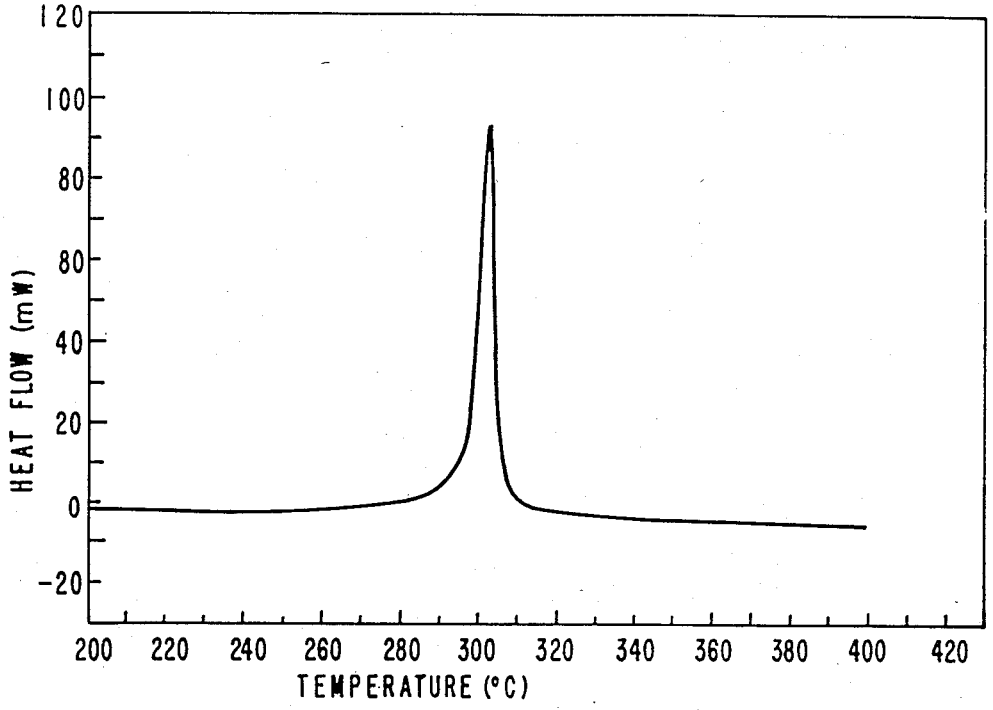
FIG. 1 shows a typical Differential Scanning Calorimetry (DSC) scan for a 96/4 mol ratio poly(acrylonitrile-co-sodium styrene sulfonate) fiber.
Figure 2:
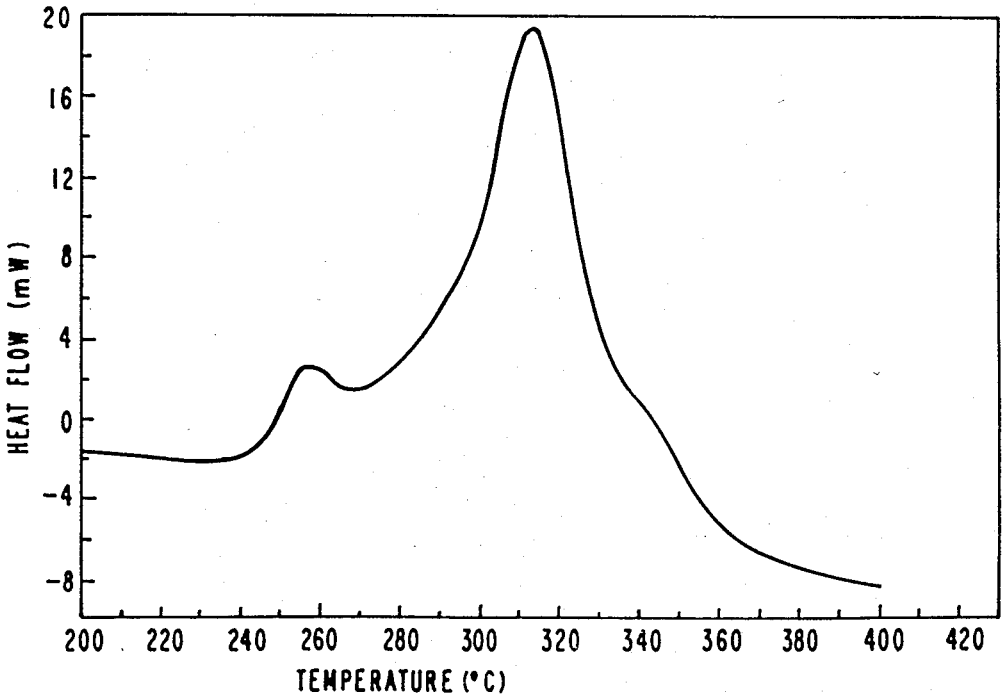
FIG. 2 is a DSC scan showing the improvement obtained by exchanging the sodium counterions of the fiber of FIG. 1 for ammonium ions (as taught in U.S. Pat. No. 4,336,022).
Figure 3:
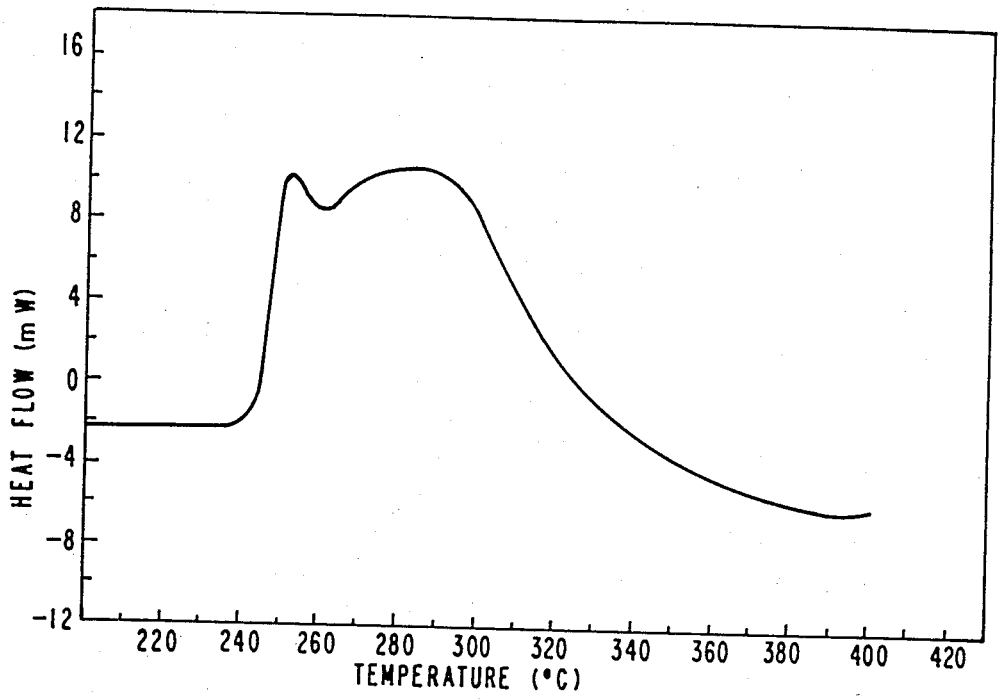
FIG. 3 is a DSC scan showing the improvement effected by an ammonium bromide treatment in accordance with the invention.
Figure 4:
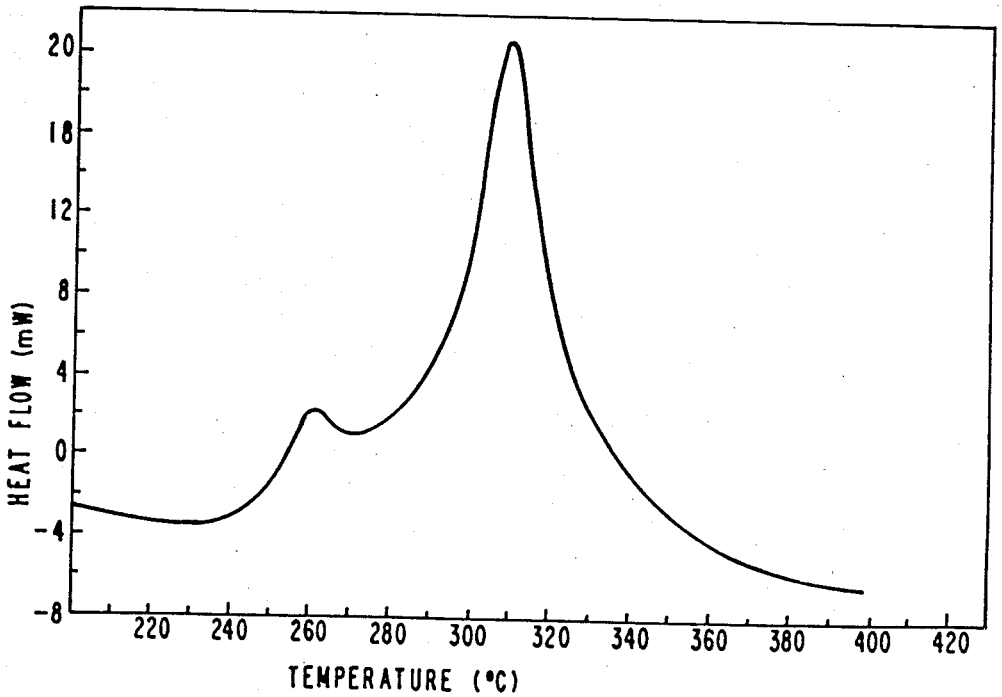
FIG. 4 is a DSC scan which shows that ammonium chloride gives no improvement as compared to ammonium bromide (FIG. 3).

The present improved process involves heating a polyacrylonitrile fiber which has been impregnated with a compound selected from the group consisting of ammonium sulfamate, ammonium bromide and ammonium iodide in an oxidizing atmosphere at 200° C.–400° C. to form a cyclized structure in the fiber and then carbonizing the fiber by heating in a non-oxidizing atmosphere at a temperature above 800° C.

DETAILED DESCRIPTION OF THE INVENTION

The precursor fibers useful for treatment in accordance with the invention are acrylonitrile fibers including 100% polyacrylonitrile. Preferred acrylonitrile fibers contain sulfonic acid comonomers or their salts such as the sodium or ammonium salts, especially ammonium salts. Illustrative polymers are poly(acrylonitrile-co-ammonium styrene sulfonate), poly(acrylonitrile-co-ammonium methallyl sulfonate) and poly(acrylonitrile-co-ammonium acrylamidomethyl propanesulfonate).

The ammonium compounds which are effective in controlling the heat efflux from the acrylonitrile polymers are ammonium salts of certain inorganic acids, specifically ammonium sulfamate, bromide and iodide. The chloride and sulfate are not satisfactory. The salts can be applied by padding or any other convenient method.

As mentioned above, the useful salts provide a more gradual, controlled rate of heat evolution during oxidative stabilization which results in higher tensile properties after carbonization. This effect can be observed and measured. Furthermore, because the heat evolution is spread out over a wider temperature range, a faster range of stabilization is possible, thereby providing an important advantage over prior art processes. After the precursor fibers are impregnated with the selected ammonium salt, they are heated in an oxidizing atmosphere at temperatures generally in the range of 200° to 400° C. The oxidizing atmosphere is preferably air.

In general, sufficient cyclization has been achieved when the fibers reach a density of at least 1.35 g/cm$^3$. The precursor fibers usually have a density of about 1.18 g/cm$^3$. The cyclized intermediate fibers may be converted to carbon or graphite fibers by methods known in the art, e.g., heating the intermediate fibers in an inert gas at 800° to 1500° C. or higher for a short period of time. Carbon fibers will have a density of at least 1.70 g/cm$^3$. In the carbonization step, the atmosphere must be non-oxidizing. Nitrogen or argon are preferred media. The cyclization of the fiber is usually carried out at constant fiber length or slight draw by application of tension as is known in the art.

Thermal cyclization of acrylic fiber becomes runaway unless slow heating rates are employed. The present invention allows faster cyclization to be achieved by use of selected ammonium salts which reduce the heat surges.

TEST PROCEDURES

Differential Scanning Calorimetry: A thermal analyzer (Du Pont 1090 Thermal Analyzer) is used to provide the DSC scans. In each case, a measured weight of fiber was inserted in the sample holder sealed in air, and heated under a flow of nitrogen at the rate indicated in the figures. The rate of heat evolution is recorded at the various temperatures. The sample weights were normalized to permit comparison.

Heat Flux Index: Refer to FIG. 5. A base line is drawn for the DSC scan and the height of the highest peak of heat flux above the base line is measured. The sides of the highest peak are extended to the base line and the line segment of the base line intersected by these extensions constitute the peak width. The ratio of one half peak height (a in FIG. 5) to peak width at half peak height (b in FIG. 5) is the Heat Flux Index (HFI). The smaller the HFI, the more efficient the heat spread, provided of course that the same size sample, rate of heating and other conditions are comparable. This technique provides a convenient way to measure the efficacy of heat efflux control.

Tensile Properties are measured on 1" filament samples tested at 10% strain rate on an Instron® tensile tester. Density determinations are made in calibrated density gradient tubes as known in the art.

EXAMPLE 1

Samples of (a) polyacrylonitrile, (b) poly(acrylonitrile-co-methylvinyl ketone) (90/10 mole ratio), (c) poly(acrylonitrile-co-sodium styrene sulfonate (96/4 mole ratio), and (d) poly(acrylonitrile-co-acrylamido methylpropane ammonium sulfonate) (96/4 mole ratio) fibers were soaked in 1% ammonium sulfamate for 1 hour and then air dried. The samples together with water treated controls were suspended in a hot air oven under ~5 mg/denier tension and heated to 250° C. and held at 250° C. for 1 hour. Samples were cooled and density measured. Results below show higher densities for the ammonium sulfamate treated samples.

| | Density | | | |
|---|---|---|---|---|
| | a | b | c | d |
| water control | 1.3006 | 1.3026 | 1.3010 | 1.3529 |
| ammonium sulfamate | 1.3406 | 1.3167 | 1.3724 | 1.3731 |

EXAMPLE 2

Samples of 100% polyacrylonitrile fiber were padded with 1% aqueous ammonium sulfamate by passing round a 4" diameter feed roll partially immersed in the ammonium sulfamate solution and then passed at constant length directly into a series of three 18" Lindberg Hevi-Duty ovens at 250°-280°-300° C. Traverse through the ovens was 60 minutes. Density of the ammonium sulfamate-treated sample was 1.4067 whereas that of a water-treated control was 1.3737. Repeating with a 30 minute traverse gave densities of 1.3361 for the sulfamate sample and 1.3000 for the control.

Examples 1 and 2 show that higher density values are achieved in the cyclization step in equal processing times and conditions when the ammonium sulfamate is employed as compared to controls.

EXAMPLE 3

Acrylonitrile/sodium styrenesulfonate (96/4 mol %) yarn was traversed through three 18" Lindberg Hevi-Duty ovens at 250°, 280° and 300° C. with a 10 minute residence time in air using a 1.2 X draw ratio. Prior to entering the first oven the yarn was passed over a feed roll (3-4 wraps) partially immersed in aqueous ammonium sulfamate of 0, 0.5, 1.0, 2.0, 5.0% concentration. The stabilized fibers were then carbonized by winding on graphite holders (the fiber is relatively loose in the holder) and heating in nitrogen to 997° C. over 1 hour, maintaining at 997° C. for 1 hour and cooling to room temperature over 5 hours. Results are shown below.

| % Ammonium Sulfamate | Stabilized Fiber Density | Carbonized Density | 1" Filament Tensiles T/E/$M_i$ gpd |
|---|---|---|---|
| 0 | 1.3243 | — | 5.0/0.9/549 |
| 0.5 | 1.3365 | — | 3.9/0.8/508 |
| 1 | 1 3518 | 1.7598 | 26/2.6/872 |
| 2 | 1.3573 | 1.7836 | 29/2.5/1038 |
| 5 | 1.3651 | 1.8498 | 3.6/0.9/502 |

It is obvious that the more controlled cyclization promoted by the ammonium sulfamate leads to significantly higher tensile properties. The drop-off in properties at the 5% ammonium sulfamate concentration is due to fiber sticking believed caused by the presence of too much salt as indicated by the abnormally high carbonized density.

EXAMPLE 4

The copolymer of acrylonitrile/sodium styrenesulfonate (96/4 mole ratio) was treated with 1% aqueous solutions of the following salts, dried and then the Heat Flux Index determined as described previously. Results are shown below.

| | HFI |
|---|---|
| Control - no catalyst | 0.8-1.0 |
| 1% ammonium iodide | 0.01 |
| 1% ammonium sulfide | 3.0 |
| 1% tetraethyl ammonium bromide | 0.6 |
| 1% tetramethyl ammonium iodide | 0.5 |
| 1% anthraquinone ammonium sulfonate | 0.9 |

EXAMPLE 5

A dried fiber copolymer of acrylonitrile/sodium styrene-sulfonate (96/4 mole ratio) in which the sodium ion had been replaced by ammonium via acidification with sulfuric acid, followed by water washing and neutralization with ammonia was soaked for 1 hour in 1% aqueous solutions of the following potential catalysts, then dried and the Heat Flux Index measured as described previously. Results are shown below.

| | HFI |
|---|---|
| Control - no catalyst | 0.04 |
| 1% ammonium iodide | 0.01 |
| 1% tetramethyl ammonium iodide | 0.02 |
| 1% ammonium chloride | 0.04 |
| 1% ammonium fluoroborate | 0.03 |
| 1% ammonium carbonate | 0.60 |
| 1% tetraethyl ammonium bromide | 0.03 |
| 1% ammonium chromotropate | 0.04 |
| 1% ammonium formate | 0.02 |

EXAMPLE 6

A sample of a commercial acrylic fiber poly(acrylonitrile-co-methylacrylate/co-itaconic acid ~97/2/1 mole ratio) was treated with 1% aqueous ammonium iodide, dried and then the Heat Flux Index measured. The result was 0.03 whereas an untreated control gave 0.9.

Examples 3-6 show that better control of heat efflux is achieved during cyclization with use of the ammonium salts of strong acids as described above.

EXAMPLE 7

A control sample of poly(acrylonitrile-co-sodium styrene sulfonate) was ammoniated by soaking skeins of the fiber in 1N $H_2SO_4$ for 1 hour, rinsing with distilled water, soaking in 1N $NH_4OH$ for 1 hour, rinsing with distilled water and air drying. Test samples were treated similarly except that they were soaked for 1 hour in either 1% aqueous ammonium iodide, ammonium formate, ammonium sulfamate or ammonium selenate prior to drying. Samples of test and control fiber were passed through 3 Lindberg ovens (18" each) in air, at 260°-280°-300° C. The rate of windup to feed rate was 1.2 X. The yarns were passed through the ovens in different experiments with total residence times of 15-60 minutes.

The stabilized yarns were then passed through a 36" Lindberg oven, set at 1150° C. and blanketted well with nitrogen to avoid oxidation. Total residence time in this oven was 15 minutes. Tensile property results for 1" filaments of the resulting carbon fibers are shown in FIG. 6. These show that the ammonium iodide treatment results in carbon fiber with higher tensile properties.

I claim:

1. In a process of preparing high strength, high modulus carbon fibers, wherein a precursor consisting of acrylic fiber selected from the group consisting of polyacrylonitrile, poly(acrylonitrile-co-styrene sulfonic acid), poly(acrylonitrile-co-methallyl sulfonic acid), poly(acrylonitrile-co-acrylamidomethyl propanesulfonic acid) and the sodium or ammonium salts of such sulfonic acid copolymers, poly(acrylonitrile-co-methylvinyl ketone) and poly(acrylonitrile-co-methylacrylate-co-itaconic acid) is heated in an oxidizing atmosphere at 200° to 400° C. to form a cyclized structure in the fiber and then the cyclized fiber is carbonized by heating in a nitrogen or argon atmosphere at a temperature above 800° C., the improvement comprising impregnating the precursor fiber with a compound selected from the group of ammonium sulfamate, ammonium bromide and ammonium iodide.

2. The process of claim 1 wherein the impregnating compound is ammonium sulfamate.

3. The process of claim 1 wherein the impregnating compound is ammonium bromide.

4. The process of claim 1 wherein the impregnating compound is ammonium iodide.

* * * * *